US008275279B2

(12) United States Patent
Naito et al.

(10) Patent No.: US 8,275,279 B2
(45) Date of Patent: Sep. 25, 2012

(54) IMAGE FORMING APPARATUS WITH OPERATION OF IMAGE BEARING MEMBER AFTER IMAGE FORMATION

(75) Inventors: Norihito Naito, Numazu (JP); Takayoshi Kihara, Suntou-gun (JP); Masahito Kato, Suntou-gun (JP); Takashi Kase, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 12/831,381

(22) Filed: Jul. 7, 2010

(65) Prior Publication Data

US 2011/0008064 A1 Jan. 13, 2011

(30) Foreign Application Priority Data

Jul. 8, 2009 (JP) ..... 2009-162265
Jun. 29, 2010 (JP) ..... 2010-148183

(51) Int. Cl.
*G03G 15/00* (2006.01)
*G03G 21/00* (2006.01)

(52) U.S. Cl. ..... 399/71; 399/43; 399/44

(58) Field of Classification Search ..... 399/71, 399/43, 44, 343, 350, 34
See application file for complete search history.

(56) References Cited

U.S. PATENT DOCUMENTS 7,120,376 B2 10/2006 Saito et al.
7,212,755 B2 * 5/2007 Onishi ..... 399/34
7,609,986 B2 * 10/2009 Sanmonji ..... 399/34
2004/0165900 A1 * 8/2004 Arimura ..... 399/343 X
2007/0286636 A1 * 12/2007 Inada et al. ..... 399/101

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a rotatable drum; a charging roller for electrically charging the drum; a developing device for developing a latent image formed on the drum into a developer image; a cleaning device for removing a developer remaining on the drum after transfer; and a control device. The cleaning device includes a cleaning blade contacting the drum. The control device is capable of performing an operation for rotating the drum, in a direction identical to the rotational direction of the drum during image formation effected by rotating the drum, after a lapse, without next instruction of image formation, of a predetermined period from a stop of rotation of the drum after completing image formation. The predetermined period is longer with a larger number of sheets subjected to the image formation in an image forming job before the rotation of the image bearing member is stopped.

10 Claims, 9 Drawing Sheets

(a)

(b)

IMAGE FORMING APPARATUS WITH OPERATION OF IMAGE BEARING MEMBER AFTER IMAGE FORMATION

FIELD OF THE INVENTION AND RELATED ART

The present invention relates to an image forming apparatus of an electrophotographic type, such as a copying machine, a printer or a facsimile machine. More specifically, the present invention relates to the image forming apparatus including a drum-like electrophotographic photosensitive member (hereinafter referred to as a "photosensitive drum"), a contact charging device for electrically charging the surface of the photosensitive drum, and a cleaning member for cleaning the surface of the photosensitive drum (hereinafter referred to as a "cleaning blade").

As the image forming apparatus of the electrophotographic type, e.g., there is the image forming apparatus of an ordinary transfer type using an electrophotographic process represented by a Carlson process. In such an image forming apparatus, the photosensitive drum as an image bearing member is repeatedly used. For that reason, a charging device is required for removing a transfer residual developer remaining on the photosensitive drum after a developer image formed on the photosensitive drum is transferred onto a recording material such as paper. As the charging device, those of various types have been known. Of these, a blade (type) charging device has been widely used.

The blade charging device scrapes and removes the transfer residual developer from the photosensitive drum by bringing a cleaning blade having flexibility (rubber elasticity) as the cleaning member into contact with the photosensitive drum in a predetermined press-contact state to wipe the photosensitive drum surface. Further, the cleaning blade is generally disposed in counterdirectional contact with the photosensitive drum with respect to a rotational direction of the photosensitive drum during image formation in order to improve a cleaning efficiency. With expansion of the markets of an electrophotographic apparatus, a disposition environment and operating condition range widely. Therefore, various manners of use are assumed, so that improvements in environment responsiveness, durability, ease of use, and stability have been continued. Particularly, with respect to the blade charging device, with emphasis on the disposition environment, a material for the cleaning member is devised. As a result, a member improved in property as the cleaning member so as not to lose its rubber elasticity even in a wide range of the disposition environment has been employed. Specifically, a rubber member exhibits a sufficient cleaning property even in a low-temperature environment in which the rubber elasticity is liable to be lost.

In the blade charging device as described above, in a rest state of the image forming apparatus, i.e., in a photosensitive drum rotation stop state, the following problem occurs. That is, a sliding property (friction coefficient μ) in a photosensitive drum surface area corresponding to a cleaning blade contact area (nip area) of the photosensitive drum is liable to be changed into a state different from that in another photosensitive drum surface area. This causes an occurrence of a stripe on an image or image blur (density fluctuation or the like) during subsequent image formation.

It has been known that the change in sliding property in the photosensitive drum surface area corresponding to the cleaning blade contact area of the photosensitive drum is attributable to the following factor.

That is, the change in sliding property is caused by agglomeration of a residue, such as a developer or an external additive with a small particle size remaining in the cleaning blade contact area, by being pressed against the photosensitive drum surface with a press-contact force of the cleaning blade. Generally, the friction coefficient μ in the photosensitive drum surface area corresponding to the cleaning blade contact area of the photosensitive drum varies at a level lower than that of the friction coefficient μ in another photosensitive drum surface area.

For that reason, a rotational speed of the photosensitive drum is changed when the image forming apparatus is redriven to rotate the photosensitive drum and the photosensitive drum surface area corresponding to the cleaning blade contact area in which the friction efficiency is decreased is returned to the contact portion between the photosensitive drum and the cleaning blade. That is, a frictional force between the photosensitive drum and the cleaning blade is changed, so that the rotational speed of the photosensitive drum is changed to a higher value at the moment when the photosensitive drum surface area passes through the contact portion between the photosensitive drum and the cleaning blade. At this time, the stripe or the image blur (the density fluctuation or the like) with a period of the photosensitive drum occurs at a portion where the image has been formed on the photosensitive drum and at a portion from which the image has been transferred onto a recording material.

In order to essentially solve the above problem, it is not reliable that the cleaning blade is retracted from the photosensitive drum surface when the image forming apparatus is in a rest state. However, in this case, a retracting mechanism is costly. It is difficult to ensure accuracy of the contact state, thus resulting in defective cleaning. By extension, an image quality is lowered. When the cleaning blade contacts the photosensitive drum again, there arises such a problem that the cleaning blade is required to contact a photosensitive drum area, which has been cleaned before the retraction, in order not to create an uncleaned area.

As a conventional example, a method in which an agglomerated developer stagnating at an edge portion of the cleaning blade contacting the photosensitive drum has been proposed. Specifically, a means for rotating, immediately after the photosensitive drum is stopped, the photosensitive drum in the same direction as that during the image formation by a distance corresponding to at least a cleaning blade contact width and then for stopping the photosensitive drum again has been proposed (U.S. Pat. No. 7,120,376).

However, in the case where the photosensitive drum is slightly operated immediately after the stop thereof as described in the conventional example, there has arisen a problem such that a sufficient effect is not achieved in some printing condition and some disposition environment and thus an improper charging image occurs.

SUMMARY OF THE INVENTION

The present invention has been accomplished in view of the above problem.

A principal object of the present invention is to provide an image forming apparatus capable of decreasing a degree of improper charging caused by deposition, on a charging device, of scraped powder of a photosensitive drum deposited and accumulated at a downstream portion of a cleaning blade nip and of a substance such as an additive separated and dropped from a developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, an image forming apparatus according to the present invention will be described more specifically with reference to the drawings.

Embodiment 1

Embodiment 1 of the present invention will be described. In this embodiment, an "image forming area" refers to an area of a photosensitive drum in which an image (latent image or toner image) to be subjected to image formation on a recording material (recording medium) as a toner image receiving member is to be formed. Further, "during image formation" refers to a period of time when respective process means for charging, exposure, development, transfer, and the like act on the photosensitive drum in the image forming area. Strictly speaking, "during image formation" with respect to the charging and "during image formation" with respect to the transfer refer to different periods of time. Further, "during non-image formation" refers to a period of time except the "during image formation".

Figure 1:
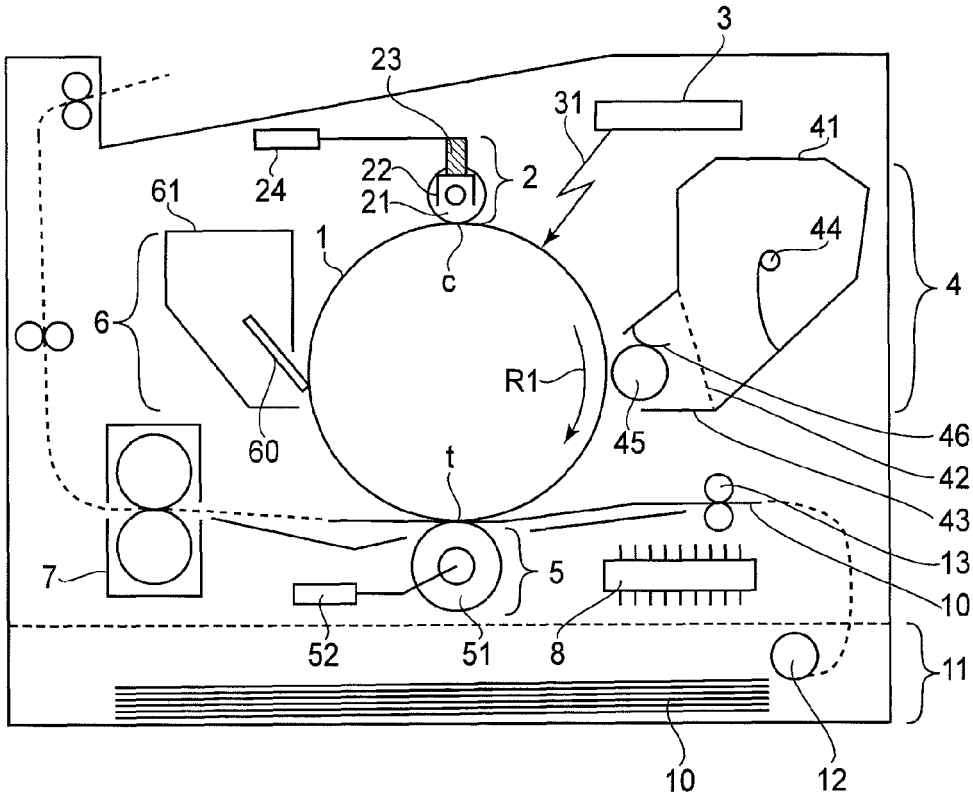
FIG. 1 is a schematic illustration of the image forming apparatus according to the present invention in Embodiment 1.

FIG. 1 is a schematic illustration of the image forming apparatus in this embodiment. In this embodiment, at a central portion of the image forming apparatus, a drum-like electrophotographic photosensitive member, i.e., a photosensitive drum 1 is disposed. The photosensitive drum 1 is rotatably provided.

At a periphery of the photosensitive drum 1, the following members are provided.

That is, a charging device 2 for uniformly charging the photosensitive drum 1 through discharging; an exposure device 3 for forming with a laser beam 31, on the charged photosensitive drum 1, an electrostatic latent image corresponding to print information and image information; a developing device 4 for visualizing (developing) the electrostatic latent image formed on the photosensitive drum 1 into a developer image (i.e., a toner image) with a developer; a transfer device 5 for transferring the toner image onto a recording material (recording medium) 10 as a toner image receiving member; a cleaning device 6 for removing transfer residual toner or the like remaining on the photosensitive drum 1; a fixing device 7 for permanently fixing the toner image transferred on the recording material 10; and a cassette 11 as a sheet feeding device for feeding the recording material 10.

The respective members will be described more specifically. The photosensitive drum 1 has, on an aluminum cylinder of 24 mm in diameter, a three-layer structure consisting of an about 1 μm-thick undercoat layer, a several μm-thick charge generating layer (CGL), and an about 15 μm-thick charge transporting layer (CTL) which are successively formed by application and lamination through dipping processing and the like. Further, the photosensitive drum 1 is rotationally driven at a predetermined peripheral speed in a direction indicated by an arrow R1 by a driving means. In this embodiment, the photosensitive drum 1 is rotated at the peripheral speed of 113.1 mm/sec, i.e., 1.5 turns per second.

The charging device 2 is principally constituted by a charging roller 21 as a charging member, an electroconductive supporting member 22, a spring member 23 and a charging bias voltage source 24. The charging roller 21 is constituted by a core metal of 6 mm in diameter, an about 3 mm-thick electroconductive elastic layer formed with an urethane rubber on the core metal, and a several μm-thick high-resistive layer formed with the urethane rubber, in which carbon black is dispersed, on the elastic layer. The supporting member 22 rotatably supports the charging roller 21 at both end portions of the charging roller 21. The spring member 23 presses, together with the supporting member 22, the charging roller 21 against the photosensitive drum 1 so that the charging roller 21 contacts the photosensitive drum 1 with a proper contact pressure. The charging bias voltage source 24 applies a voltage to the charging roller 21 through the spring member 23 and the supporting member 22.

The charging roller 21 is provided so that it contacts the photosensitive drum 1 at a charging portion c and is rotated by rotation of the photosensitive drum 1. The charging roller 21 is supplied with a charging bias exceeding a discharge start voltage from the charging bias voltage source 24 to cause electric discharge between the photosensitive drum 1 and the charging roller 21, thus electrically charging the photosensitive drum 1.

Incidentally, the discharge start voltage refers to a potential difference at which the electric discharge starts between the charging roller 21 and the photosensitive drum 1. In the case where the voltage is applied to the charging roller 21, a surface potential of the photosensitive drum 1 is obtained by subtracting the discharge start voltage from the voltage applied to the charging roller 21. In the constitution of this embodiment, the discharge start voltage is 500 V. To the charging roller 21, a DC voltage of about −1000 V is applied, so that the photosensitive drum 1 is charged to have the surface potential of −500 V.

Here, in this embodiment, a contact charging method in which the DC voltage with no AC voltage is applied to the charging roller 21 to charge the photosensitive drum 1, i.e., a so-called DC charging method is employed. The DC charging method has the advantages of low ozone, low cost, and the like, compared with an AC charging method in which a voltage in the form of the DC voltage biased with the AC voltage is applied to the charging roller 21. Further, in addition, the DC charging method requires a small amount of a current for the electric discharge in order to charge the surface of the photosensitive drum 1 to a predetermined potential, thus having the advantage of a small scraped amount of the surface of the photosensitive drum 1.

As the exposure device 3, in this embodiment, a laser beam scanner is used. This scanner includes a semiconductor laser, a polygonal mirror, f-θ lens, and the like. Further, the scanner emits the laser beam 31, which has been subjected to ON/OFF control depending on the image information sent from an unshown host device, thus scanning-exposing the uniformly charged surface of the photosensitive drum 1 to the laser beam to form the electrostatic latent image on the photosensitive drum 1. In this embodiment, the exposure device 3 adjusted in laser light quantity so that the surface potential (exposure potential) in an exposed area of the photosensitive drum 1 is −150 V is used.

The developing device 4 is partitioned into a toner container 41 for containing the toner and a developing container 43 by a partitioning portion 42. Further, in the toner container 41, a stirring device 44 is disposed and feeds the toner to the developing container 43. In the developing container 43, a developing roller 45 used for developing the electrostatic latent image on the photosensitive drum 1 and a regulating blade 46 for regulating a toner layer thickness on the developing roller 45 are disposed. As a developing method, a jumping developing method and a two component developing method and the like may be employed. In this embodiment, image exposure and reverse development are used in combination. The electrostatic latent image is reverse-developed with the toner, so that the toner image as a visible image is formed.

The transfer device 5 includes a transfer roller 51 as a transfer member which has a diameter of 16 mm and a surface layer formed of a foam member such as an electroconductive type sponge or an ion conductive type sponge, and includes a transfer bias voltage source 52 for applying a voltage to the transfer roller 51. The transfer roller 51 and the photosensitive drum 1 contact each other at a transfer portion t, and the toner image is transferred from the photosensitive drum 1 onto the recording material 10 when the recording material 10 passes between the transfer roller 51 and the photosensitive drum 1. In this embodiment, the reverse development is employed, so that a transfer bias of a positive polarity opposite to the polarity of the toner charged on the photosensitive drum 1 by the charging roller 21 is applied to the transfer roller 51. In this embodiment, even when the recording material 10 is not present at the transfer portion t, the transfer bias is applied so as to detect a resistance of the transfer roller 51 to effect resistance detection control (active transfer voltage control (ATVC) or programmable transfer voltage control (PTVC)). By effecting the resistance detection control in advance of the image formation, a proper transfer bias stable irrespective of a disposition environment of the image forming apparatus or a resistance fluctuation of the transfer roller can be applied during the image formation. Further, by detecting the resistance fluctuation of the transfer roller 51, it is also possible to detect the disposition environment and the like.

The recording material 10 as the toner image receiving member accommodated in the cassette 11 as the sheet feeding device is fed by the sheet feeding roller 12 to registration rollers 13 in synchronism with the formation of the visible image on the photosensitive drum 1. Then, the recording material 10 is conveyed by the registration rollers 13 between the transfer roller 51 and the photosensitive drum 1 in synchronism with a leading end of the visible image formed on the photosensitive drum 1. The toner image on the photosensitive drum 1 is transferred onto the recording material 10 by applying the transfer bias to the transfer roller 51.

The toner image transferred on the recording material 10 is conveyed together with the recording material 10 into the fixing device 7, in which the toner image is fixed on the recording material 10 under application of heat and pressure to result in a recorded image.

Separately, the transfer residual toner remaining on the photosensitive drum 1 after passing through the transfer device 5 position is removed from the photosensitive drum 1 by the cleaning device 6 including a cleaning blade 60 as a cleaning member formed with a polyurethane rubber, and is collected in a residual toner container 61.

Thereafter, the surface of the photosensitive drum 1 is electrically charged again by the charging device 2 in order to prepare for subsequent image formation.

A CPU 8 as a control device controls the voltages to be applied to the charging roller 21, the developing roller 45 and the transfer roller 51 by controlling the charging bias voltage source 24, a developing bias voltage source (not shown) and the transfer bias voltage source 52, respectively. Further, together with the CPU 8, a storing device (not shown) such as an RAM or the like is connected, and information on the disposition environment or operating condition of the printer (image forming apparatus) is stored, so that the information can be reflected in the image forming operation.

Further, in the constitution of the image forming apparatus in this embodiment, as described above, the peripheral speed of the photosensitive drum 1 is 113.1 mm/sec. Further, with respect to a print speed, sheets of the recording material 10 were conveyed with a sheet interval such that A4-sized sheets can be continuously subjected to printing at the print speed of an about 15 sheets/minute. In this embodiment, the sheet interval between two consecutive sheets is 166 mm corresponding to two-full circumference of the photosensitive drum 1. The sheet interval is ensured by adjusting sheet feeding timing of the recording material 10.

Figure 2:
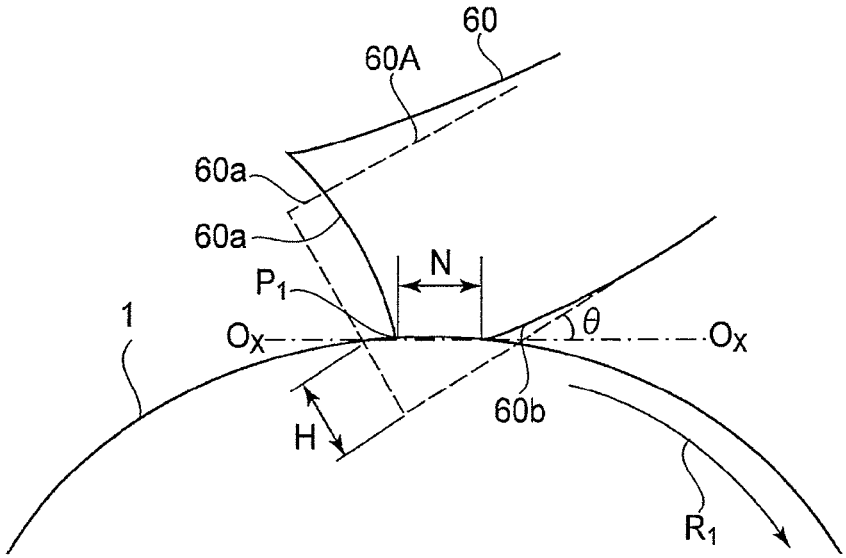
FIG. 2 is a schematic illustration of cleaning blade setting.

A constitution of the cleaning device 6 in the present invention will be described. Referring to FIG. 2, the cleaning blade 60 and the photosensitive drum 1 are characterized in that they contact each other counter-directionally with respect to the rotational direction R1. This means that a free end (contacting the photosensitive drum 1) of the cleaning blade 60 is located upstream of a fixed end of the cleaning blade 60 with respect to the rotational direction R1 of the photosensitive drum 1. The cleaning blade 60 is adjusted and disposed so that the cleaning blade 60 can have a certain areal nip width N with respect to the photosensitive drum 1, from its leading edge portion P1.

That is, a phantom cleaning blade 60A indicated by a broken line in FIG. 2 is considered. This cleaning blade 60A is adjusted so that it has an inclination angle θ from a photosensitive drum tangential line Ox-Ox and has an entering amount H which is a depth through which a cleaning blade end position 60*a* of the phantom cleaning blade 60A enters the photosensitive drum 1 surface. As a result, the cleaning blade 60 is actually disposed in contact with the photosensitive drum 1 with the certain areal nip width N from the leading edge portion P1. In this embodiment, an experiment was conducted by employing a constitution in which the phantom cleaning blade 60A had the inclination angle θ of 25 degrees and the entering amount H of 1 mm.

The contact portion between the cleaning blade 60 and the photosensitive drum 1 is the cleaning nip N. The cleaning blade 60 has a cleaning blade surface 60*b* located downstream of the cleaning nip N with respect to the photosensitive drum rotational direction (hereinafter referred to as a cleaning nip downstream portion).

Figure 3:
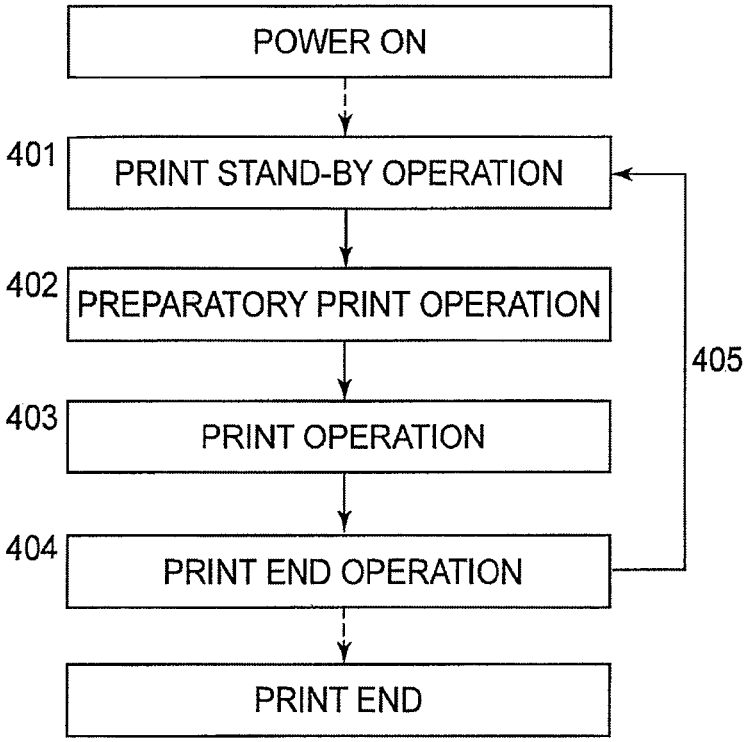
FIG.3 PRIOR ART
FIG. 3 is a flow chart for illustrating an operation of a conventional image forming apparatus.

Next, a printing process which has been conventionally employed will be described. Referring to FIG. 3, the printing process includes four operations of a print stand-by operation 401, a print preparing operation (preparatory print operation) 402, a printing operation 403 and a print ending operation 404. The respective operations will be described below.

The print stand-by operation 401 is performed in a state in which the printer (image forming apparatus) is on stand-by so that the operation can go to the printing operation when a print instruction is input from a personal computer. Specifically, in the print stand-by operation 401, a step of pre-heating the fixing device and a step of detecting the disposition environment and the like step are performed. When the print instruction is input, the printer starts its actuation as the print stand-by operation. In the print preparing operation 402, e.g., measurement of a resistance of the transfer roller or the like of the transfer device, a step of uniformly charging the photosensitive drum to a desired dark portion potential, a step of warming the fixing roller or the like in order to obtain a sufficient fixing property, or the like step are performed. Then, in the case where a condition on which the operating can go to the printing operation is satisfied, the operation goes to the printing operation 403. In the printing operation, i.e., the image forming operation on the recording material, the recording material is fed from the sheet feeding tray or the like, and separately the electrostatic latent image is formed on the photosensitive drum by the laser exposure or the like depending on the image data, followed by the development with the developer, the transfer onto the recording material, and the fixation of the developer on the recording material. In parallel, an operation is performed for collecting an untransferred developer, which has not been transferred by the transfer device, by the cleaning device and for cleaning the surface of the photosensitive drum so as to be placed in a repetitive image formable state. After a series of the printing operation steps is completed, the operation goes to the print ending operation 404. In the print ending operation 404, a discharging step of electrically discharging the photosensitive drum surface and cleaning of the transfer device and the fixing device are performed. Further, as described in the conventional example, the slight rotation operation for preventing deposition of a foreign matter on the photosensitive drum is also performed as the print ending operation 404. At the same time of completion of the print ending operation 404, the operation goes to the print stand-by operation 401 (405), so that the printer is on stand-by until it receives the print instruction again. Incidentally, in the print preparing operation 402 and the print ending operation 404, the photosensitive drum 1 is rotated.

As described in the conventional example, the occurrence of the image defect due to the deposition of the scraped powder of the photosensitive drum or the like on the cleaning blade will be explained with reference to FIGS. 4(*a*) and 4(*b*).

Herein, the image defect generated by deposition on the charging roller of fine powder, such as the scraped powder of the photosensitive drum or an external additive powder for the developer, which has been deposited at the nip downstream portion 60*b* of the cleaning blade and then has been separated and dropped from the nip downstream is referred to as a "drive stripe contamination". Further, substances causing the drive stripe contamination are collectively referred to as a "drive stripe substance".

First, a causative substance (i.e., the drive stripe substance) causing the drive stripe contamination will be described.

The cleaning blade 60 is provided for removing and collecting transfer residual toner T1, which has not been transferred from the photosensitive drum 1 in the transfer step, so as not to adversely affect a subsequent image forming process. In some cases, the cleaning blade is provided for removing and collecting powder with relative large particle size such as the developer and therefore it has been reported that fine powder T2 such as the scraped powder of the photosensitive drum or the external additive for the developer passes through the cleaning nip N. However, the amount of the fine powder T2 passing through the cleaning nip N is very small and therefore it has not been reported that the image defect is generated by the fine powder T2 passing through the cleaning nip N. Most of the fine powder T2 is deposited and conveyed on the photosensitive drum as fine powder T3 as it is even when the fine powder T2 passes through the cleaning nip N and then is repetitively subjected to a step in which the fine powder T3 is removed by the cleaning operation in many cases. However, the fine powder passing through the cleaning nip N can possess viscosity and adhesive property depending on setting of the cleaning blade, an operating environment such as a high-temperature and high-humidity environment or a large-volume printing environment, and the like, thus being deposited on the cleaning blade in some cases. As shown in FIG. 4(*a*), by repetition of such slight deposition of the fine powder, the deposited fine powder gradually grows as a drive stripe substance T4 at the nip downstream portion 60*b* of the cleaning blade.

Figure 4:
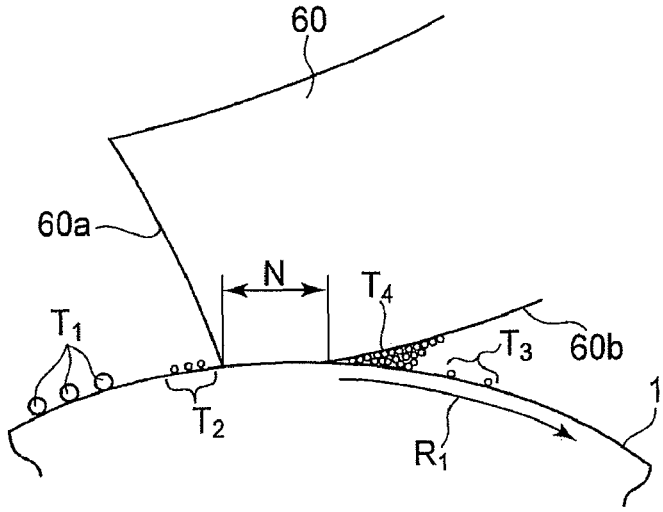
FIG.4 PRIOR ART
FIGS. 4(*a*) and 4(*b*) are schematic views for illustrating a cleaning blade contact portion.
Figure 4:
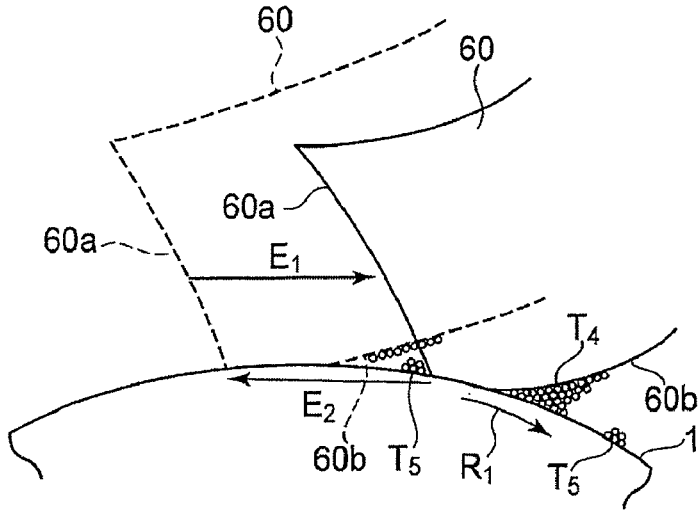
FIG.4 PRIOR ART

Further, in some operating environments, it has been confirmed that the cleaning blade can be strained (deformed) in the rotational (driving) direction R1 by a distance E1 as shown in FIG. 4(*b*). This phenomenon is frequently observed in the high-temperature and high-humidity environment, in the case of a large print number and in the case of a long rotation time. Further, the strain (E1) of the cleaning blade is, in the case where the photosensitive drum is stopped after the completion of the printing operation, released (E2) although a pace of the release of the strain is very slow. The releasing time is roughly determined depending on an amount of the strain.

It has been found by study that the drive stripe substance T4 deposited on the cleaning blade is liable to be separated and dropped from the cleaning blade with timing when the strain of the cleaning blade is released (E2). During the large-volume printing, the cleaning blade is largely strained toward the rotational direction downstream side (E1). Then, in a largely strained state, the drive stripe substance T4 accumulates and grows at the cleaning blade nip downstream portion 60*b*. After the printing operation, the strain (E1) of the cleaning blade is gradually released (relaxed) (E2) until a subsequent printing operation is performed. An opening area of the cleaning blade nip downstream portion is gradually decreased along a process of the release (E2). Further, the drive stripe substance T4 deposited at the cleaning blade nip downstream portion 60*b* is rubbed against the photosensitive drum in the state in which it is deposited on the cleaning blade. As a result, the drive stripe substance T4 loses a place to go and is separated from the cleaning blade surface by being rubbed against the photosensitive drum and then is dropped on the photosensitive drum as a drive stripe substance T5.

The drive stripe substance T5 dropped on the photosensitive drum is conveyed in a subsequent printing process by the rotation of the photosensitive drum. Thereafter, the drive stripe substance T5 is nipped and pressed between the photosensitive drum 1 and the charging roller 21, thus being transferred onto the charging roller 21. As a result, at the portion where the drive stripe substance is deposited on the charging roller, the image defect (drive stripe contamination) occurs in a black stripe shape on a half-tone image or an entire white image with a charging roller pitch. Further, a deposition amount of the drive stripe substance and a level of the occurrence of the image defect show a correlation therebetween and in some cases, when the drive stripe substance is deposited in a small amount, the occurrence level is such that the image defect does not occur.

According to a study by the present inventors, it has been found that the drive stripe contamination can cause the occurrence of the image defect even in the case where the photosensitive drum is slightly operated immediately after the photosensitive drum is stopped as described in the conventional example.

Further, when the photosensitive drum is slightly operated immediately after the photosensitive drum is stopped as in the conventional example, it has been also found that the drive stripe contamination is less liable to occur in the case where a large-volume printing is not effected in a very short time. On the other hand, in the case where the large-volume printing is effected in the very short time, it has been found that the drive stripe contamination is liable to occur. That is, in the above-described condition, it has been found that an improper charging image is liable to occur by separation and drop of the drive stripe substance from the cleaning blade to be deposited on the charging roller.

This may be attributable to strain of the cleaning blade toward the rotational direction downstream side by movement of the charging roller by the rotation of the photosensitive drum in the cleaning operation. In the case where the amount of strain is large, the drive stripe substance is liable to deposit and accumulate at the cleaning blade nip downstream portion.

An experiment for checking a relationship between the print number and an occurrence level of the drive stripe contamination was conducted. In the experiment, a predetermined print number of sheets are printed and then after a lapse of a stand-by (waiting) time of 12 hours, the printing operation is performed again. When the printing operation was performed, a state of an occurrence of the drive stripe contamination was evaluated. The stand-by time means a time period, from completion of a certain image forming job to start a subsequent image forming job, in which the photosensitive drum 1 is stopped. In the experiment, the stand-by time refers to a time period from completion of a printing operation for accumulation of the drive stripe substance until a printing operation for checking the influence of the drive stripe substance. By printing the predetermined print number of sheets, the drive stripe substance is accumulated on the cleaning blade downstream side. Then, by the stand-by for 12 hours, the drive stripe substance is dropped from the cleaning blade by release of the strain of the cleaning blade. Then, the drive stripe substance was deposited on the charging roller by the printing operation after the photosensitive drum stand-by time and then the evaluation of the drive stripe contamination was effected.

As a print operation condition, intermittent sheet passage with instantaneous stop of the photosensitive drum every one-sheet printing and continuous sheet passage through continuous printing with no instantaneous stop of the photosensitive drum every one-sheet printing were employed.

The results are shown in Table 1 below.

A criterion for evaluation was as follows.

A: No occurrence of the drive stripe contamination was observed,

B: An intermediate level between level A and level C.

C: The occurrence of the drive stripe contamination was slightly observed.

D: An intermediate level between level C and level E.

E: The occurrence of the drive stripe contamination was clearly observed.

F: A level at which the drive stripe contamination was wider and thicker than the drive stripe contamination at level E.

TABLE 1

| | Sheets | | | |
|---|---|---|---|---|
| | 0-250 | 251-500 | 501-750 | 751-1000 |
| Intermittent | A | C | E | F |
| Continuous | A | B | C | E |

In the case of the intermittent sheet passage, the drive stripe contamination was not observed with respect to the smaller print number (0th to 250th) (level A) but was slightly observed in a section from 251st to 500th (level C) and then was clearly observed in a section from 501st to 750th (level E). In a section from 751st to 1000th, the width and thickness of the drive stripe contamination were further increased (level F).

In the case of the continuous sheet passage, compared with the intermittent sheet passage, the timing of the occurrence of the drive stripe contamination is delayed. For example, in the case where the comparison is made at the level C at which the drive stripe contamination was slightly observed, the drive stripe contamination occurs in the section from 251st to 500th in the intermittent sheet passage and on the other hand occurs in the section from 501st to 750th in the continuous sheet passage. This is attributable to a phenomenon that the print preparing operation and the print ending operation are performed every one-sheet passage in the intermittent sheet passage and therefore the number of rotations of the photosensitive drum in the intermittent sheet passage is larger than that in the continuous sheet passage even if the print number is the same. That is, even in the same print number, the strain amount E1 of the cleaning blade in the intermittent sheet passage is larger than that in the continuous sheet passage, so that the occurrence timing of the drive stripe substance is earlier in the intermittent sheet passage. From the result of the experiment, it is understood that there is a correlation between the cleaning blade stain amount E1 and the occurrence of the drive stripe contamination.

Thus, even in either case of the intermittent sheet passage and the continuous sheet passage, in the case where a large-volume printing is performed in a short time, the occurrence level of the drive stripe contamination reaches the level E. However, until the print number reaches about 250th, the occurrence level of the drive stripe contamination is very slight even when the drive stripe contamination occurs and is such that the drive stripe contamination is not recognizable unless the charging roller is carefully observed.

Figure 8:
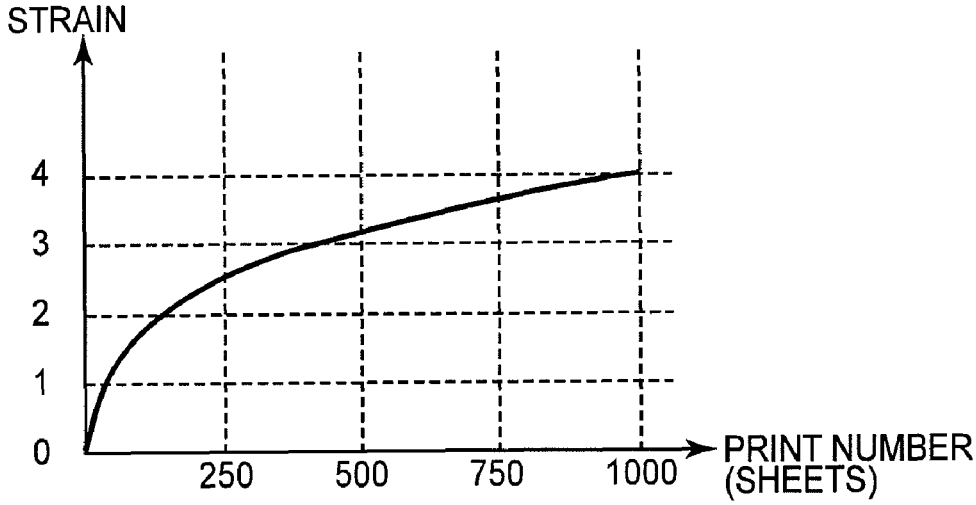
FIG. 8 is a graph showing a relationship between a print number and an amount of strain of the cleaning blade in the image forming apparatus of the present invention in Embodiment 1.

FIG. 8 shows the cleaning blade strain amount as the result of the experiment (the intermittent sheet passage) shown in Table 1. In FIG. 8, the strain amount in the constitution of this embodiment corresponds to 0.1 mm of the entering amount of the cleaning blade per one graduation (division) in the ordinate. In FIG. 8, the strain amount at the time of start of the printing is taken as zero and the state of the change in strain by the printing operation is shown. It was confirmed that the strain amount was largely changed at a relatively early stage and the strain was accumulated substantially linearly.

Further, in each of the sections of the print number, it was found that the strain amount was returned to zero as a result of the strain release process after the lapse of the stand-by time of 12 hours. Therefore, it can be said that the occurrence level is worsened with a larger cleaning blade strain amount E1 and that the occurrence level of the drive stripe contamination is correlated with the cleaning blade strain amount.

In the above experiment, the stand-by time of 12 hours was provided after completion of the printing and the correlation between the print number and the occurrence level of the drive stripe contamination was confirmed by the means for releasing the cleaning blade strain.

Next, an experiment for observing an occurrence state of the drive stripe contamination was conducted in such a manner that the photosensitive drum was once stopped after completion of the printing operation on the predetermined print number of sheets without providing the stand-by time of 12 hours and immediately thereafter the image formation was effected again. A result of the experiment is shown in Table 2 below. In the case where the stand-by time of 12 hours is not provided, the drive stripe contamination does not occur. This may be attributable to the phenomenon that the drive stripe contamination occurs due to the deposition of the drive stripe substance on the photosensitive drum 1 by the release of the cleaning blade strain. Even in the case of the large-volume printing, the drive stripe substance is little deposited on the photosensitive drum 1 at the time, immediately after the printing, when the cleaning blade strain is less liable to be released.

TABLE 2

| | Sheets | | | |
|---|---|---|---|---|
| | 0-250 | 251-500 | 501-750 | 751-1000 |
| Intermittent | A | A | A | A |
| Continuous | A | A | A | A |

Figure 9:
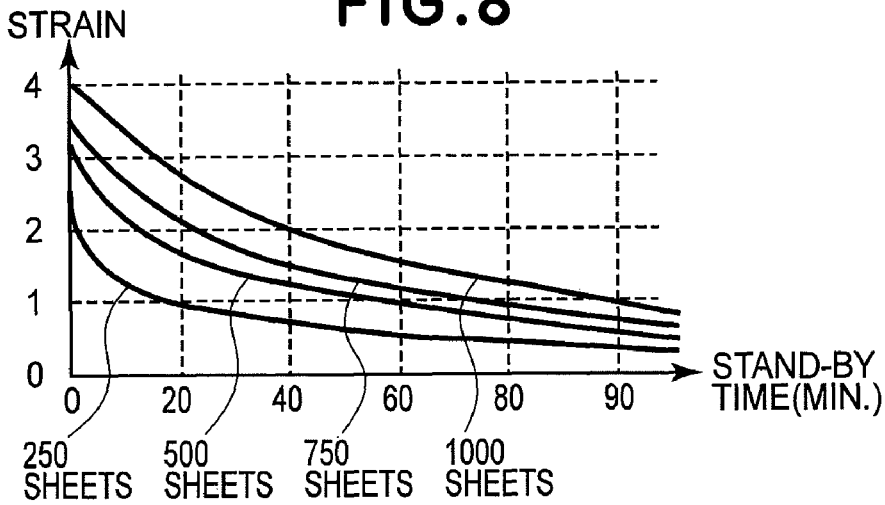
FIG. 9 is a graph showing a relationship between the cleaning blade stain amount and a stand-by time in the image forming apparatus of the present invention in Embodiment 1.

Next, the correlation between the occurrence level of the drive stripe contamination and the release of the cleaning blade strain was determined by changing the print number and the stand-by time which is the time period until the subsequent print was effected. The occurrence level of the drive stripe contamination is shown in Table 3 below and the level of the cleaning blade strain is shown in FIG. 9. From these results, it was found that there was the correlation between the print number and the strain amount. Further, it was also found that there was the correlation between the relaxation time and the occurrence level of the drive stripe contamination. These have also been confirmed from the results of Table 1 and FIG. 8 as described above.

TABLE 3

| (MIN.) | 10 | 20 | 30 | 45 | 60 | 120 | 12 × 60 |
|---|---|---|---|---|---|---|---|
| 250 | A | A | A | A | A | A | C |
| 500 | A | B | C | C | C | C | D |
| 750 | A | B | C | C | D | D | E |
| 1000 | A | B | C | D | D | E | F |

In the present invention, in order to prevent the drive stripe substance from separating and dropping from the cleaning blade in a large amount during the stand-by period, a driving stripe preventing sequence in which the drive (rotation operation) of the photosensitive drum is effected for a predetermined time (hereinafter simply referred to as a "sequence") is performed. A feature of the direction is such that a time (sequence actuation time) from completion of the printing operation to execution of the sequence is changed depending on the print number in an immediately preceding image forming job. Incidentally, the above-described predetermined time for which the drive of the photosensitive drum is effected is a very short time, which is generally within several seconds, i.e., two to three seconds. This is because an effect of decreasing the drive stripe substance is not enhanced even when the rotation operation is continued for a time more than the predetermined time and therefore unnecessary rotation of the photosensitive drum is obviated.

As shown in Table 3, the occurrence level of the drive stripe contamination varies depending on the print number and the stand-by time.

Therefore, the sequence actuation time was not depending on the print number in the immediately preceding image forming job as shown in Table 5.

TABLE 4

| | Sheets | | | |
|---|---|---|---|---|
| | 0-250 | 251-500 | 501-750 | 751-1000 |
| Time (MIN.) | — | 20 | 30 | 45 |

As a result, it was confirmed that the constitution in this embodiment employing the sequence ("EMB. 1") provided better results than those of a conventional constitution employing no sequence ("COMP. EMB.") as shown in Table 5.

TABLE 5

| | Sheets | | | |
|---|---|---|---|---|
| | 0-250 | 251-500 | 501-750 | 751-1000 |
| EMB. 1 | A | A | C | D |
| COMP. EMB. | A | C | E | F |

In the conventional constitution ("COMP. EMB.") shown in Table 5, the occurrence level of the drive stripe contamination is shown in the case where the rotation of the photosensitive drum is stopped after the completion of the printing operation on each of the sections of the print number of sheets, and the photosensitive drum is left standing for the stand-by time of 12 hours and then is subjected to the image formation again. On the other hand, in this embodiment ("EMB. 1"), the photosensitive drum is driven with the sequence actuation time set as shown in Table 4 and is then left standing for the stand-by time for 12 hours similarly as in the conventional constitution, so that the drive stripe contamination is evaluated. In this embodiment, e.g., with respect to the occurrence level of the drive stripe contamination in the print number section from 751st to 1000th, an improving effect was confirmed that the occurrence level was changed from the level F in the conventional constitution to the level D in this embodiment. In this embodiment, two drive stripes at the level D were observed.

Figure 11:
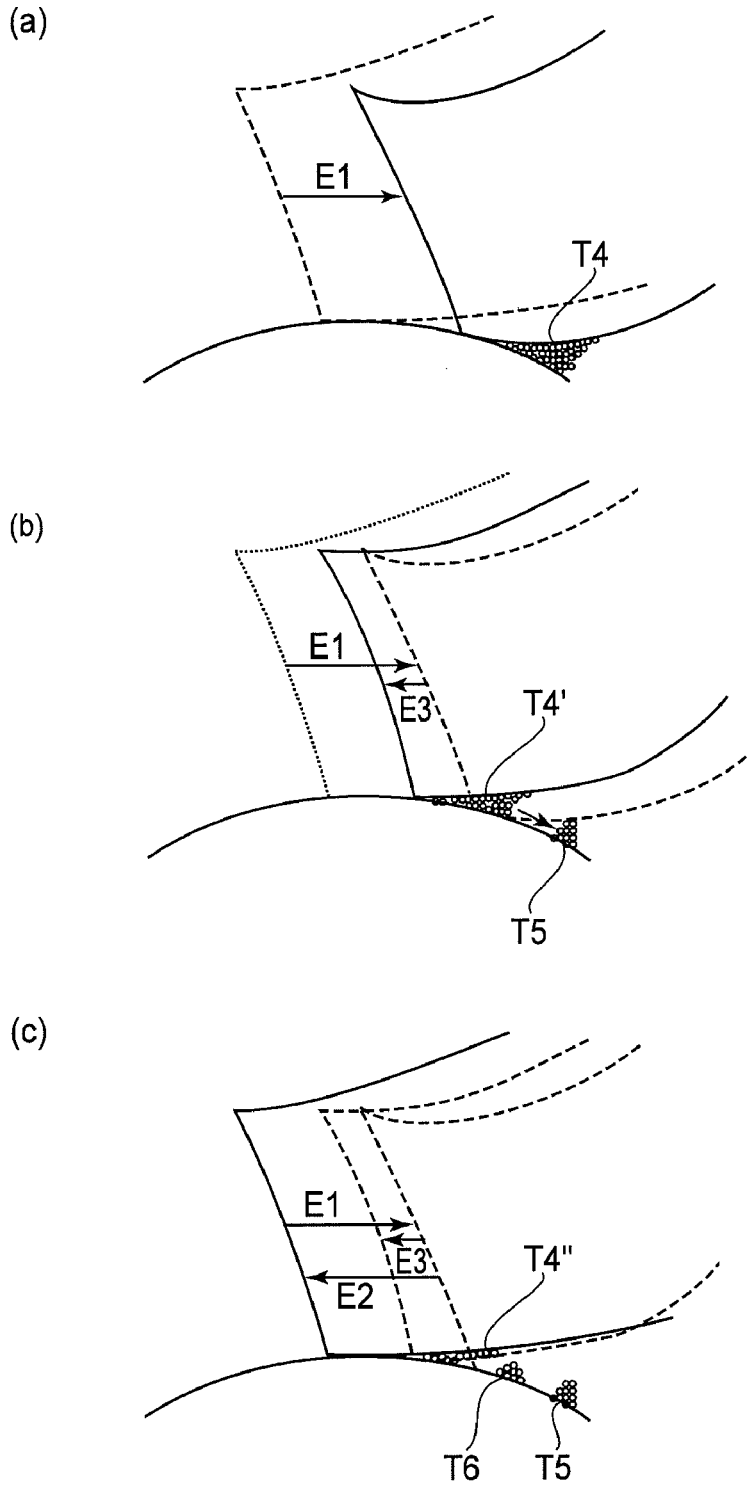
FIGS. 11(*a*), 11(*b*) and 11(*c*) are schematic views for illustrating a strain state of the cleaning blade and a state of a drive stripe substance.

This improving effect will be described with reference to FIGS. 11(*a*) to 11(*c*). When the large-volume printing is effected, as shown in FIG. 11(*a*), the cleaning blade is strained (E1) by the printing operation and at the same time, a drive stripe substance T4 is accumulated. Thereafter, the printing on a desired print number of sheets (e.g., 1000 sheets) is completed and the photosensitive drum is placed in the stand-by time state. During the stand-by time, the photosensitive drum is rotated depending on the sequence actuation time (e.g., 45 minutes). During the sequence actuation, the strain of the cleaning blade is released (E3) from the position shown in FIG. 11(*a*) to the position shown in FIG. 11(*b*). When the photosensitive drum is driven in the state in which the strain is released, the drive stripe substance pushed out from the cleaning blade nip downstream side is transferred (T5) onto the photosensitive drum. During the sequence actuation, the strain of the cleaning blade is not completely released, so that the accumulated drive stripe substance is not completely moved onto the photosensitive drum but partly remains on the cleaning blade nip downstream side (T4'). Then, after a lapse of the stand-by time of 12 hours including the sequence actuation time, as shown in FIG. 11(*c*), the strain of the cleaning blade is released (E2) to the position equivalent to a rest state. When the printing operation is performed after the strain is completely released, the drive stripe substance (T4') remaining on the cleaning blade during the sequence actuation is dropped and transferred onto the photosensitive drum (T6). Incidentally, a slight amount of the drive stripe substance which has not been transferred onto the photosensitive drum remains on the cleaning blade (T4"). As a result, in the conventional constitution, a large amount of the drive stripe substance is dropped and transferred onto the photosensitive drum in one place to cause the drive stripe contamination at the level F. However, when the sequence as in this embodiment was actuated, the drive stripe substance was able to be distributed, so that the occurrence level of the drive stripe contamination was improved to the level D. When the large amount of the drive stripe substance is transferred onto the photosensitive drum in one place, the drive stripe contamination is pressed against the charging roller with a large force during movement of the drive stripe substance to the nip between the charging roller and the photosensitive drum 1 by the rotation of the photosensitive drum 1. For that reason, the drive stripe substance is deposited on the charging roller. On the other hand, the drive stripe substance is distributed in small amounts at different positions, so that the drive stripe substance is prevented from being pressed against the charging roller with the large force and therefore the occurrence of the drive stripe contamination can be suppressed.

An effect of the change in sequence actuation time depending on the print number will be described. As shown in FIG. 9, when the print number is changed, the strain amount of the cleaning blade is also changed. For example, in the case of the printing on 250 sheets, the strain amount is 2.5 and, in the case of the printing on 1000 sheets, the strain amount is 4. After a lapse of the stand-by time of 20 minutes, the strain amount is 1 for the printing on 250 sheets and is 2.8 for the printing on 1000 sheets. That is, by the stand-by time of 20 minutes, the strain amount is decreased by 1.5 for the printing on 250 sheets and by 1.2 for the printing on 1000 sheets. When a decreasing ratio by the stand-by time of 20 minutes is considered, the strain is released (relaxed) at the decreasing ratio of 1.5/2.5 (=0.6) for the printing on 250 sheets and of 1.2/4 (=0.3) for the printing on 1000 sheets.

As described above, there is the correlation between the release of the strain and the occurrence level of the drive stripe contamination. For example, assuming that the sequence is actuated at the time of the lapse of 20 minutes irrespective of the print number, by the execution of the sequence at the time of the lapse of 20 minutes, 60% of the accumulated drive stripe substance is transferred onto the photosensitive drum in the case of the printing on 250 sheets and 30% of the accumulated drive stripe substance is transferred onto the photosensitive drum in the case of the printing on 1000 sheets. In these cases, when the printing operation is performed after the lapse of 12 hours, i.e., after the strain of the cleaning blade is completely released, a remaining portion of the drive stripe substance is transferred onto the photosensitive drum. That is, 40% of the accumulated drive stripe substance is transferred onto the photosensitive drum in the case of the printing on 250 sheets and 70% of the accumulated drive stripe substance is transferred onto the photosensitive drum in the case of the printing on 1000 sheets. As described above, in the case of the printing on 1000 sheets, the effect of distributing the drive stripe substance can be expected to some extent but there is a possibility that the large amount of the drive stripe substance is transferred onto the photosensitive drum. As shown in FIG. 9, after the lapse of 40 minutes in the case of the printing on 1000 sheets, the strain is released so that the strain decreasing ratio is decreased to ¾ (=0.5). Therefore, when the sequence is actuated after the lapse of 40 minutes, 50% of the drive stripe substance is transferred onto the photosensitive drum during the sequence actuation time and after the lapse of 12 hours, remaining 50% of the drive stripe substance is transferred onto the photosensitive drum when the printing operation is performed. In the case where the sequence is actuated after the lapse of 20 minutes, 70% of the drive stripe substance is transferred on the photosensitive drum at a time. On the other hand, when the sequence is actuated after the lapse of 40 minutes, the transfer amount of the drive stripe substance can be made smaller than 70%. Thus, by appropriately setting the sequence actuation time, it is possible to change the ratio of distribution of the drive stripe substance.

As described above, when the sequence actuation time is uniformly determined irrespective of the print number, the strain amount of the cleaning blade varying depending on the print number is not taken into consideration, so that there is a possibility that the large amount of the drive stripe substance is transferred onto the photosensitive drum in the case of printing on some print number. Therefore, in the present invention, the ratio of the distribution of the drive stripe substance can be optimized by determining the sequence actuation time in consideration of the print number.

Here, a distance in which the photosensitive drum is driven during the stand-by period, i.e., the driving time of the photosensitive drum is not required to be made large. This is because the effect of distributing the drive stripe substance is not changed even when the photosensitive drum rotation time is prolonged in the sequence in this embodiment for distributing the drive stripe substance. Further, the same distributing effect is obtained also in the very small time, so that there is no need to rotate the photosensitive drum more than necessary.

The driving sequence in the present invention will be described along a flow chart shown in FIG. 5.

Figure 5:
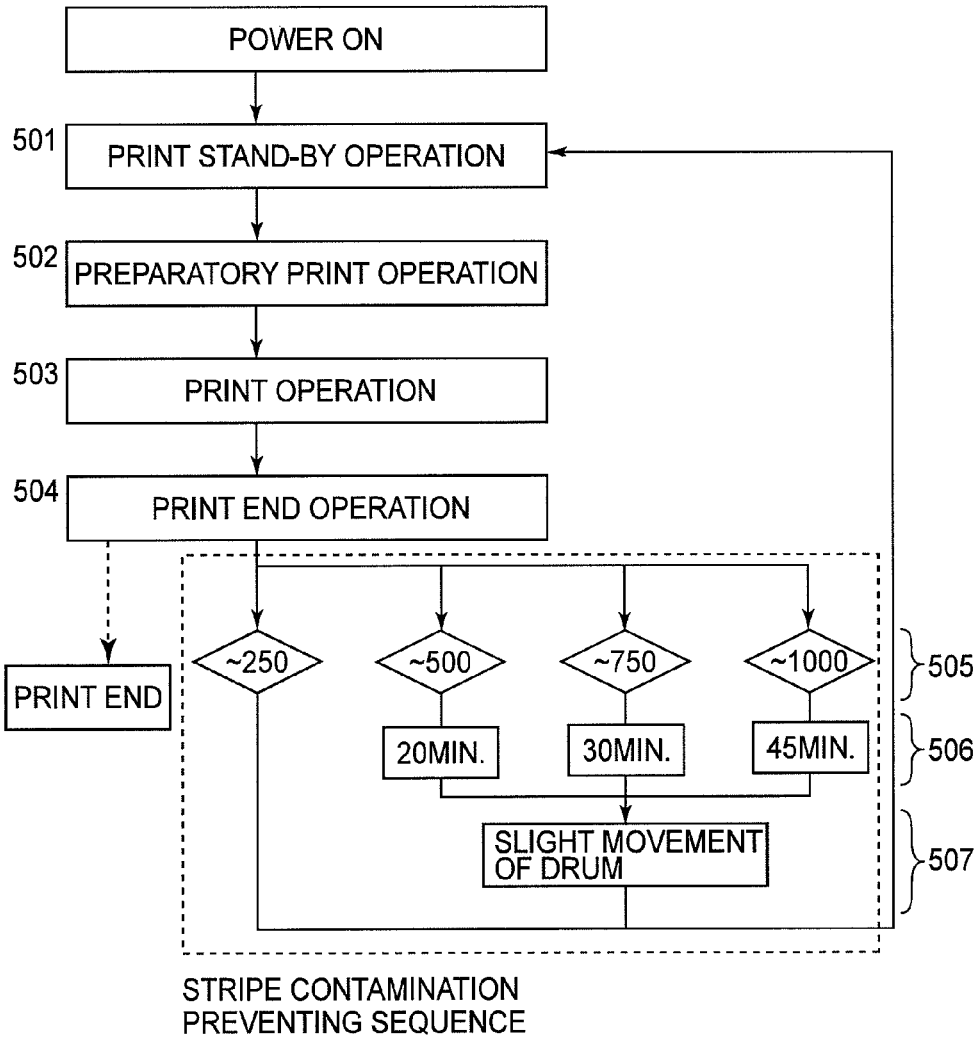
FIGS. 5, 6 and 7 are flow charts for illustrating operations of the image forming apparatus according to the present invention in Embodiments 1, 2 and 3, respectively.

Referring to FIG. 5, after the power is turned on, the operating goes from a print stand-by operation 501 to a print preparing operation (preparatory print operation) 502 when a print signal (print number or print information) is sent from a personal computer (PC) or the like and is received by the image forming apparatus. The print preparing operation 502 includes pre-heating of the fixing device, resistance deposition of the transfer device, and environment deposition by an environment sensor (environment depositing means) or the like. In the case where a series of operations as the print preparing operation is completed and the image forming apparatus is judged as being printable, the operation goes to a printing operation (print operation) 503. In the printing operation 503, the photosensitive drum is subjected to steps of charging, exposure, development, transfer, and fixation while the recording material is fed from the sheet feeding device.

Further, in the printing operation 503, the print number is counted by a CPU of the printer (image forming apparatus).

At the time when the printing on all the sheets in accordance with instructions to perform the series of the operations as the printing operation is completed, a print ending operation 504 is performed and then the operation is returned to the print stand-by operation 501.

In this embodiment, after the print ending operation 504, the operation is classified into four cases depending on a counter value of the print number (505). In each of respective conditions, the sequence actuation time for the drive stripe contamination preventing sequence is determined (506). During the print stand-by period, the rotational drive of the photosensitive drum is stopped.

After the CPU 8 counts a desired sequence actuation time, i.e., after the lapse of the sequence actuation time, the drive stripe contamination preventing sequence is executed (507). Then, the operation is returned to the print stand-by operation 501.

Further, in the case where a print start instruction is received during the stand-by period until the sequence actuation time for the drive stripe contamination preventing sequence, the operation instantaneously goes to the print preparing operation 502. In this case, the operation is before the drive stripe contamination preventing sequence, so that the drive stripe contamination does not occur or is very slight even in the case where the drive stripe contamination occurs.

As described above, the drive stripe substance depositing and accumulating on the cleaning blade nip downstream side is separated and dropped on the photosensitive drum while the cleaning blade strain is released, and is deposited on the charging roller to cause the improper charging image (the drive stripe contamination). According to the present invention, with respect to the drive stripe contamination, the photosensitive drum is slightly moved, depending on the print number of sheets subjected to the image formation in an immediately preceding print job, after the lapse of the predetermined sequence actuation time, so that the drive stripe substance is separated and dropped before the cleaning blade strain is sufficiently released. That is, the photosensitive drum is rotation-operated for a predetermined time, i.e., for a very short time during the print stand-by period in which the photosensitive drum is not driven after completion of the printing. As a result, it was possible to decrease the occurrence level of the improper charging.

In this embodiment, a degree of the drive stripe contamination occurring in a process in which the cleaning blade strain is released after completion of the printing operation by which the cleaning blade is strained in the photosensitive drum driving direction, is decreased. In this embodiment, a long strain relaxation time such as 10 minutes or 20 minutes is employed but the relaxation time for the cleaning blade is not limited thereto and varies depending on setting and material of the cleaning blade and a surface material or operation environment of the photosensitive drum. For example, also in the case where the release of the strain of the cleaning blade is performed in a very short time (e.g., several seconds), by employing a similar sequence depending on the strain relaxation time, it is possible to decrease the occurrence level of the drive stripe contamination. This is true for the case where the release of the strain of the cleaning blade is performed from a long time.

Embodiment 2

In Embodiment 1, it was possible to decrease a degree of the occurrence of the image defect resulting from the drive stripe substance by rotating the photosensitive drum during the print stand-by period. However, as a result of an experiment, the drive stripe contamination is liable to occur in a high-temperature and high-humidity environment rather than a low-temperature and low-humidity environment. This may be attributable to a phenomenon such that the drive stripe substance is increased in viscosity and adhesive property in the high-temperature and high-humidity environment and is liable to accumulate on the cleaning blade nip downstream side. As described above, such a result that the accumulation amount of the drive stripe substance is small depending on the disposition environment is also obtained. Further, as a condition in which the drive stripe substance is liable to accumulate on the cleaning blade nip downstream side, in addition to the case where the printing on a large number of sheets is performed at a time, the occurrence level of the drive stripe contamination also varies depending on a total print number of sheets which have been printed until now (i.e., a print history). It has been confirmed that the drive stripe contamination is liable to occur with a large print history) history.

Figure 12:
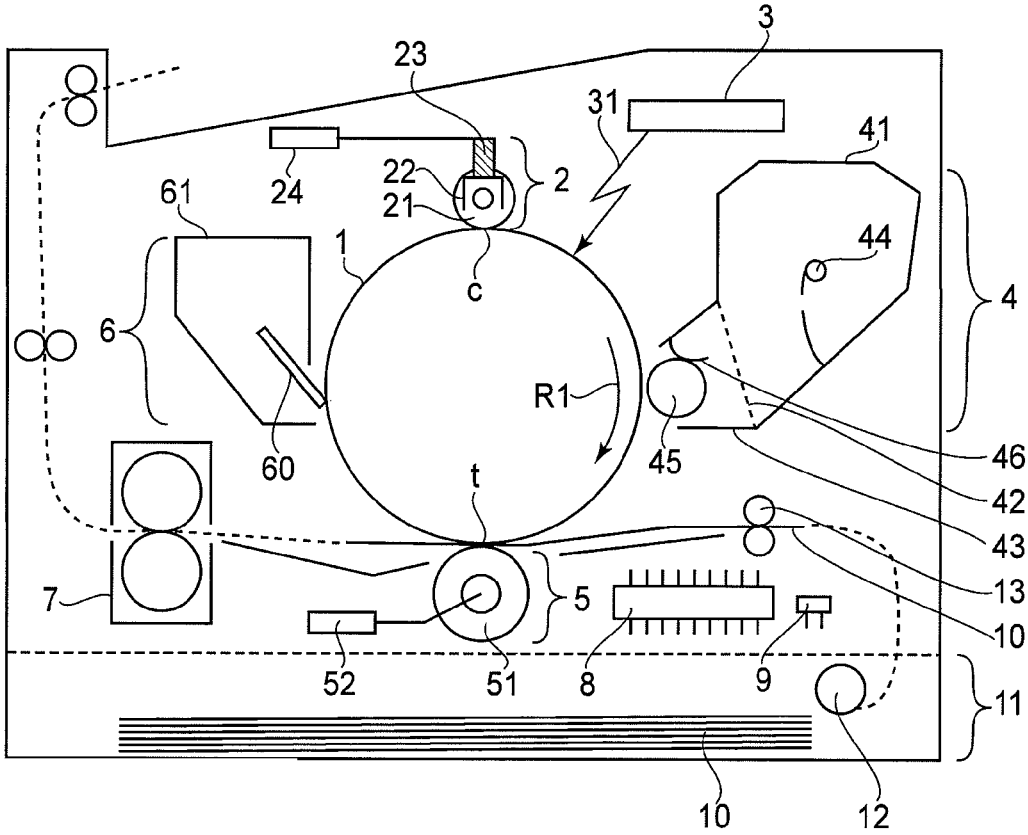
FIG. 12 is a schematic illustration of the image forming apparatus according to the present invention in Embodiment 2.

Embodiment 2 is characterized in that the drive stripe contamination preventing sequence described in Embodiment 1 is optimized depending on the operation environment and the total print number. An image forming apparatus in this embodiment is shown in FIG. 12. The image forming apparatus is identical to that in Embodiment 1 except that an environment depositing means 9 is provided. The environment depositing means 9 is capable of depositing the operation environment (temperature, humidity) of the image forming apparatus.

First, an experiment with respect to the operation environment and the occurrence level of the drive stripe contamination is performed. A condition of the experiment is identical to that in Embodiment 1 and the print number is 250 sheets, 500 sheets, 750 sheets and 1000 sheets. Further, comparison is made by setting the stand-by time until checking of the drive stripe contamination occurrence level at 12 hours after completion of the printing. The operation environment was a high-temperature/high-humidity environment (30° C./80% RH), a central environment (20° C./50% RH), and a low-temperature/low-humidity environment (10° C./20% RH). A result is shown in Table 6.

TABLE 6

| Environment | 250 | 500 | 750 | 1000 |
|---|---|---|---|---|
| 30° C./80% RH | A | C | E | F |
| 20° C./50% RH | A | A | C | E |
| 10° C./20% RH | A | A | C | C |

As shown in Table 6, compared with the drive stripe contamination occurrence level in the central environment (20° C./50% RH), the drive stripe contamination occurrence level was improved. When the cleaning blade or the like was observed after the completion of the experiment, with a better result of the drive stripe contamination occurrence level as in the low-temperature/low-humidity environment, a trace of the deposition of the drive stripe substance was thinner and shorter. Thus, it was confirmed that the drive stripe contamination was also very small quantitatively. It is considered that the viscosity of the fine powder such as the scraped powder is changed depending on the temperature/humidity condition and the amount of the drive stripe substance is small in the low-temperature/low-humidity environment.

Next, the correlation between the print history and the drive stripe contamination occurrence level was determined. The experiment condition was such that the drive stripe contamination occurrence level was observed by using the cleaning blade in a sequence in which one-sheet intermittent printing on three predetermined print numbers of sheets (0 sheets, 500 sheets and 1000 sheets) was conducted before the drive stripe contamination evaluation and then the stand-by time of 12 hours was provided to return the strained state of the cleaning blade to the rest state. A result is shown in Table 7.

TABLE 7

| History | 250 | 500 | 750 | 1000 |
|---|---|---|---|---|
| 0 | A | C | E | F |
| 500 | C | E | E | F |
| 1000 | C | E | F | F |

As shown in Table 7, the occurrence of the drive stripe contamination is more noticeable in a state in which the print history is larger, i.e., the history of 500 sheets larger than the history of 0 sheets and the history of 1000 sheets larger than the history of 500 sheets. Compared with the state in which the print history was 0 sheets, in the state in which the print history was 1000 sheets, a clear difference in print number of the occurrence of the drive stripe contamination was confirmed such that the print number of the occurrence of the drive stripe contamination at the level C was 500 sheets for the history of 0 sheets and was 250 sheets for the history of 1000 sheets. This may be attributable to a phenomenon such that in the case of the larger print history, the scraped powder of the photosensitive drum, the fine powder of the additive to the developer, and the like have already been collected in the neighborhood of the cleaning blade and thus the amount of the powder capable of generating the drive stripe substance is large.

A result of the optimization of the sequence described in Embodiment 1 on the basis of the operation environment and the print history is shown in Table 8.

TABLE 8

| | Sheets | | | |
|---|---|---|---|---|
| | 0-250 | 251-500 | 501-750 | 751-1000 |
| 10° C./20% RH | —/—/— | —/—/10 | 20/20/30 | 30/45/45 |
| 20° C./50% RH | —/—/10 | —/20/20 | 30/30/30 | 45/45/45 |
| 30° C./80% RH | —/10/20 | 10/20/30 | 30/45/45 | 45/45/45 |

In FIG. 8, for example, "–/–/10" means that the drive stripe contamination preventing sequence is not performed in the cases of the print history of 0 sheets and the print history of 500 sheets but is performed after the lapse of 10 minutes only in the case of the print history of 1000 sheets.

A result of a comparison of the drive stripe contamination occurrence level between Embodiment 1 and Embodiment 2 is shown in Table 9.

As shown in Table 9, compared with Embodiment 1, the drive stripe contamination occurrence level in Embodiment 2 is improved. Also in Embodiment 1, it was found that the occurrence level was the level D or better in all the environment conditions and print history conditions but was liable to be somewhat worsened in the high-temperature/high-humidity environment (30° C./80% RH). In the case of the sequence actuation time determined depending on the print number as described in Embodiment 1 which can cause the worse drive stripe contamination occurrence level, compared with the drive stripe contamination occurrence level in the central environment (20° C./50% RH), the drive stripe contamination occurrence level is worsened in some operation environment. Therefore, in Embodiment 2, the drive stripe contamination preventing sequence was optimized on the basis of information, such as the operation environment and the print history immediately before the operation, which may worsen the drive stripe contamination occurrence level, so that a better result was achieved.

The constitution in this embodiment will be described along a flow chart shown in FIG. 6.

Figure 6:
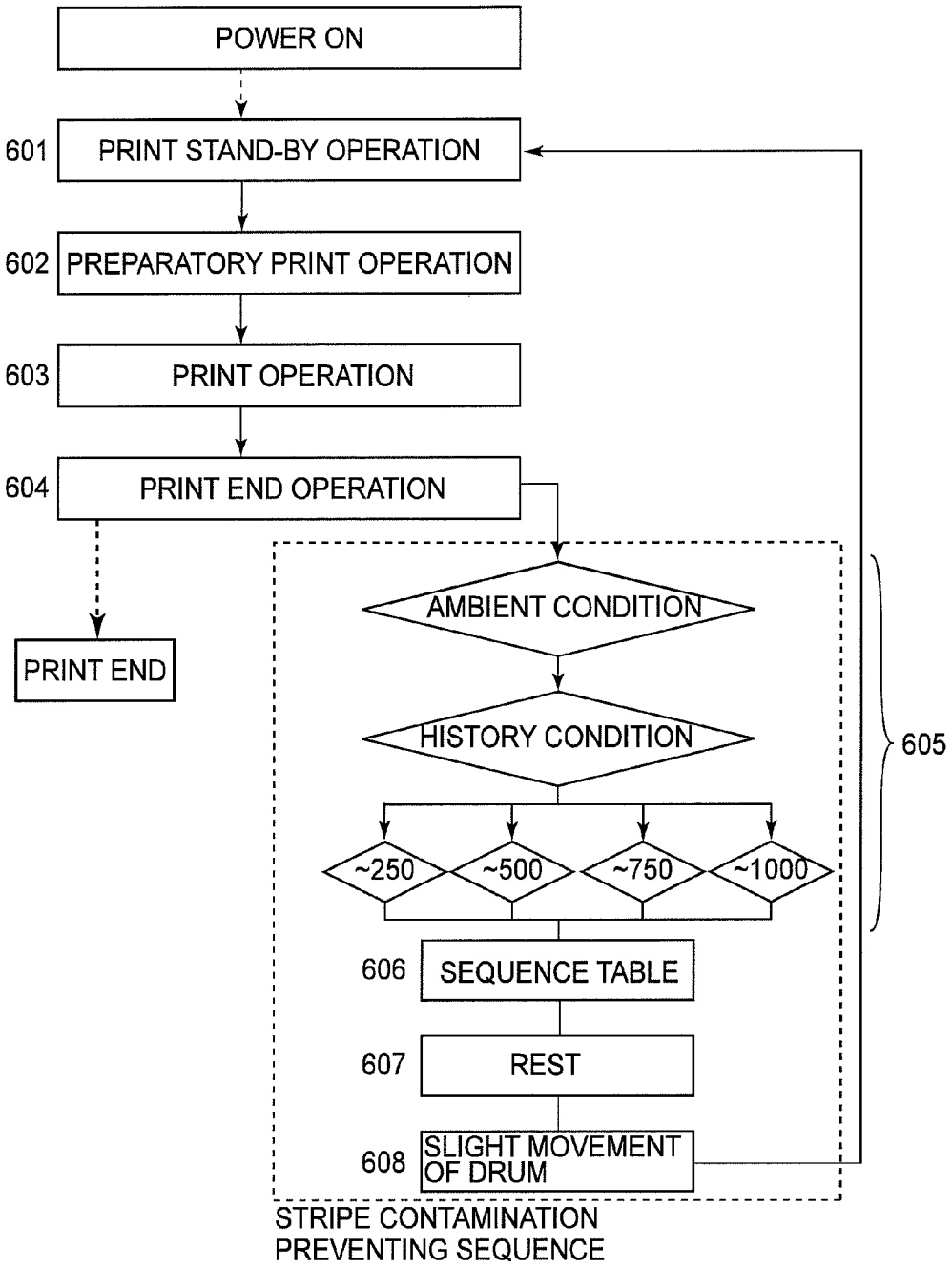

Referring to FIG. 6, after the power is turned on, the operating goes from a print stand-by operation 601 to a print preparing operation preparatory print operation) 602 when the print signal is sent from a PC or the like and is received by the image forming apparatus. The print preparing operation 602 includes pre-heating of the fixing device, resistance deposition of the transfer device, and environment deposition by an environment sensor (environment depositing means) or the like. In the case where a series of operations as the print preparing operation is completed and the image forming apparatus is judged as being printable, the operation goes to a printing operation (print operation) 603. In the printing operation 603, the photosensitive drum is subjected to steps of charging, exposure, development, transfer, and fixation while the recording material is fed from the sheet feeding device.

Further, in this embodiment, an integrated print number (the number of reception of print information) which is a total integrated print number of sheets which have been printed is stored in the CPU 8 in the main assembly of the printer (image forming apparatus) in advance. In this embodiment, the CPU 8 is a storing means for storing the integrated print number but the integrated print number may also be stored in a non-volatile memory other than the CPU 8.

Further, when the printing operation is started, the print number in the printing step (the number of sheets subjected to the image formation in a current image forming job) is counted by the CPU 8 or the like in the printer.

At the time when all the printing operations performed in response to required instructions for a series of the printing operations are completed, a print ending operation 604 is

TABLE 9

| | ENVIRONMENTAL | 0-250 HISTORY | | | 251-500 HISTORY | | | 501-750 HISTORY | | | 751-1000 HISTORY | | |
|---|---|---|---|---|---|---|---|---|---|---|---|---|---|
| | CONDITON | 0 | 500 | 1000 | 0 | 500 | 1000 | 0 | 500 | 1000 | 0 | 500 | 1000 |
| EMB. 1 | 30° C./80% RH | A | A | A | B | C | D | C | D | D | D | D | D |
| | 20° C./50% RH | A | A | A | A | C | C | C | C | D | D | D | D |
| | 10° C./20% RH | A | A | A | A | A | B | B | C | C | C | C | C |
| EMB. 2 | 30° C./80% RH | A | A | A | A | C | C | C | C | D | D | D | D |
| | 20° C./50% RH | A | A | A | A | C | C | C | C | D | D | D | D |
| | 10° C./20% RH | A | A | A | A | A | A | A | B | B | B | B | B |

performed and the operation goes to the print stand-by operation 601 through the drive stripe contamination preventing sequence.

In this embodiment, the time until the sequence is actuated, i.e., the sequence actuation time is determined after the completion of the print ending operation 604 from an operation condition 605 including the operation environment condition obtained from an environment detection value by the environment sensor, the operation history condition obtained from the integrated print number in the CPU, the print number obtained from a counter value for the print number in the printing step, and the like. In this embodiment, the manner of determining the sequence actuation time is complicated. For this reason, a sequence table 606 is prepared and by checking the sequence table 606 against a detection condition, an optimum condition is determined. After the sequence actuation time is determined, the print number in the printing step is added to the integrated print number. After the optimum condition is determined, a rest 607 of the photosensitive drum is carried out until the time reaches a desired (predetermined) sequence actuation time. During the rest period, the rotation of the photosensitive drum is stopped. After the lapse of the predetermined sequence actuation time, a drive stripe contamination preventing operation (slight movement of the photosensitive drum) 608 is performed. Then, the operation is returned to the print stand-by operation 601.

For example, in this embodiment, in accordance with the sequence actuation times shown in Table 8, an effect is achieved. The sequence table 606 is a condition table such as Table 8. As an example, in the case where the operation environment condition of 30° C./80% RH, the integrated print number of 500 sheets as the operation history condition, and the print number counter value of 300 sheets in the printing step are employed, from Table 8, the sequence actuation time is determined as 20 minutes.

As described above, it was confirmed that even when start timing of the drive stripe contamination preventing sequence was changed depending on the operation environment or the operation history information, it was possible to obtain a similar effect. Specifically, when the temperature/humidity condition is changed from the low-temperature/low-humidity environment to the high-temperature/high-humidity environment through the central environment, the accumulation amount of the drive stripe substance is liable to be increased. This is because the cleaning blade is softer with an increasing temperature by its temperature characteristic. As a result, the strain amount of the cleaning blade in the printing step is early increased. Further, the drive stripe substance is the fine powder as described above. For that reason, by the influence of moisture absorption, the drive stripe substance is increased in viscosity, thus resulting in high adhesive property and high accumulation property. Therefore, the drive stripe contamination occurrence level can be improved by prolonging the sequence actuation time with an increasing temperature or with an increasing humidity. Further, it was found that the drive stripe substance was liable to accumulate with a larger operation history. Therefore, with the larger operation history, the sequence actuation time is made longer, so that the drive stripe contamination occurrence level can be improved.

In this embodiment, as the operation history, the integrated print number is counted but the present invention is not limited thereto. The operation history is only required to be associated with the accumulation amount of the drive stripe substance on the cleaning blade and may also be such that an integrated number of rotations of the photosensitive drum 1 is counted.

As described above, even in the case where the image forming apparatus is used in a severe operation condition, by employing the sequence described in this embodiment, it is possible to obtain a stable image irrespective of the operation environment.

Embodiment 3

In Embodiment 1, by rotating the photosensitive drum during the print stand-by period, it was possible to decrease the degree of the occurrence of the image defect caused due to the drive stripe contamination. However, in the sequence described in Embodiment 1, the degree of the occurrence of the drive stripe contamination can be decreased but the drive stripe contamination slightly occurs in some cases.

Figure 10:
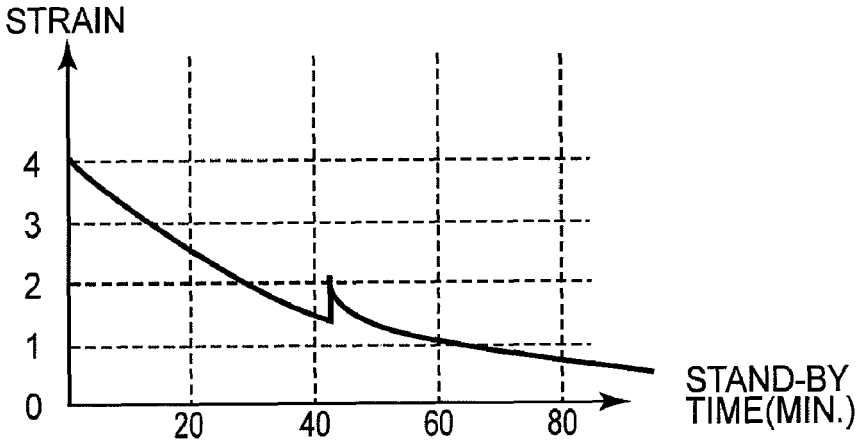
FIG. 10 is a graph showing a relationship between the cleaning blade stain amount and the stand-by time in the image forming apparatus of the present invention in Embodiment 3.

FIG. 10 shows relaxation of the strain after the printing on 1000 sheets is effected in the case where the sequence is executed. At the stand-by time of 45 minutes, the strain amount is once increased. This is attributable to the execution of the sequence. The relaxation of the cleaning blade strain is continued also during a period from the completion of the execution of the sequence to provision of a subsequent print instruction. As shown in FIG. 11(*c*), with respect to the drive stripe substance T5 separated and dropped from the cleaning blade when the drive stripe contamination preventing sequence, the strain is continuously relaxed. For that reason, in the case where the deposition amount of the drive stripe substance on the cleaning blade is extremely large, the drive stripe substance in a large amount can be separated and dropped (T6) again.

Therefore, in this embodiment, depending on the immediately preceding print condition, the drive stripe substance is prevented from separating and dropping from the cleaning blade during the print stand-by period. For that reason, the drive of the photosensitive drum in order to decrease the amount of the drive stripe substance separated and dropped from the cleaning blade is carried out plural times depending on the immediately preceding printing condition. Further, each actuation timing is changed depending on the printing condition. That is, rotation and stop of the photosensitive drum are performed plural times in a period from the stop of the rotation of the photosensitive drum once performed after completion of the image formation to the input of a subsequent image forming job.

As described also in Embodiment 1, compared with the conventional example, it was confirmed that the effect of Embodiment 1 was achieved with reliability by performing the sequence actuation depending on the immediately preceding printing condition. Further, the improving effect was such that the drive stripe contamination occurrence level F in the conventional example was improved to the drive stripe contamination occurrence level D by distributing the drive stripe substance causing the occurrence level F. In order to make the drive stripe contamination occurrence level equal to or better than the level B, the sequence actuation time and the number of execution of the sequence are optimized based on Table 3 in Embodiment 1. A result thereof is shown in Table 10.

TABLE 10

| (Sheets) | 1ST | 2ND | 3RD |
|---|---|---|---|
| 250 | — | — | — |
| 500 | 20 | — | — |
| 750 | 20 | 50 | — |
| 1000 | 20 | 40 | 70 |

As shown in Table 1, in the case where the print number in the immediately preceding printing operation is 750 sheets, the drive stripe contamination preventing sequence is performed two times. That is, the sequence is performed after the lapse of 20 minutes and 50 minutes from the completion of the immediately preceding printing. By this sequence, the drive stripe contamination occurrence level B can be realized. In Table 10, with respect to each of the print numbers, the number of execution of the sequence and the sequence actuation time vary depending on the print number in the immediately preceding printing. Further, as shown in Table 10, with an increasing print number, the number of execution of the sequence is also increased. Further, the sequence actuation time is also changed depending on the condition. Therefore, the strain relaxation time and the drive stripe contamination occurrence level vary depending on a degree of the strain of the cleaning blade.

A result of validation of the effect by the drive stripe contamination preventing sequence shown in Table 10 is shown in Table 11.

TABLE 11

| | Sheets | | | |
|---|---|---|---|---|
| | 250 | 500 | 750 | 1000 |
| EMB. 3 | A | A | B | B |
| EMB. 1 | A | A | C | D |

The experimental condition is, similarly as in Embodiment 1, such that each sheet is subjected to the intermittent printing and then the stand-by time of 12 hours is provided. As shown in Table 11, in this embodiment, with respect to the print numbers of 250 sheets and 500 sheets, the drive stripe contamination occurrence level is the level A causing no drive stripe contamination similarly as in Embodiment 1. Further, with respect to the print numbers of 750 sheets and 1000 sheets, the drive stripe contamination occurrence level is the level B at which the drive stripe contamination occurs very slightly.

The constitution in this embodiment will be described along a flow chart shown in FIG. 7.

Figure 7:
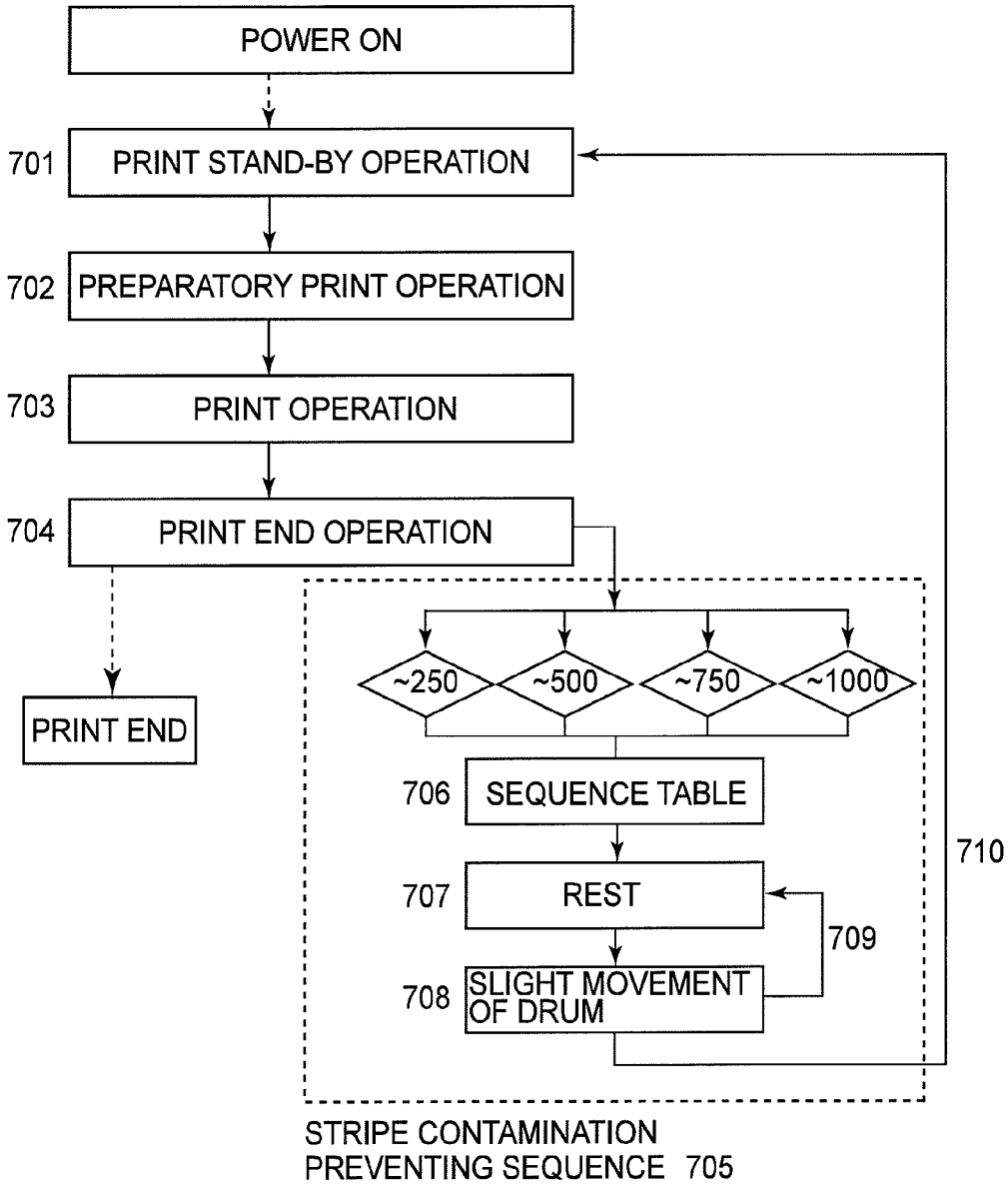

Referring to FIG. 7, after the power is turned on, the operating goes from a print stand-by operation 701 to a print preparing operation (preparatory print operation) 702 when the print signal is sent from the PC or the like and is received by the image forming apparatus. The print preparing operation 502 includes pre-heating of the fixing device, resistance deposition of the transfer device, and environment deposition by the environment sensor or the like. In the case where a series of operations as the print preparing operation is completed and the image forming apparatus is judged as being printable, the operation goes to a printing operation (print operation) 703. In the printing operation 703, the photosensitive drum is subjected to steps of charging, exposure, development, transfer, and fixation while the recording material is fed from the sheet feeding device.

Further, in the printing operation 703, the print number is counted by a CPU of the printer (image forming apparatus).

At the time when the printing on all the sheets in accordance with instructions to perform the series of the operations as the printing operation 703 is completed, a print ending operation 704 is performed and then the operation is returned to the print stand-by operation 701.

In this embodiment, after the print ending operation 704, the sequence actuation time for the drive stripe contamination preventing sequence and the number of execution of the sequence are determined depending on a counter value of the print number from a sequence table 706. After the lapse of a rest time (stand-by time) 707 in each of the conditions, the photosensitive drum is slightly moved (708). Then, the slight movement 708 of the photosensitive drum is repeated depending on the number of execution of the sequence 709.

After the predetermined drive stripe contamination preventing sequence is performed, the operation is returned to the print stand-by operation 710.

As described above, the scraped powder of the photosensitive drum and the additive to the developer which deposit and accumulate on the cleaning blade nip downstream side is separated and dropped on the photosensitive drum while the cleaning blade stain is released, and is deposited on the charging roller to cause the improper charging image, with respect to the improper charging image, the number of the slight movement performed after the print rest time and the print rest time until the slight movement and changed depending on the immediately preceding printing condition, so that the drive stripe substance is separated and dropped before the cleaning blade strain is sufficiently released. As a result, it was possible to decrease the occurrence level of the improper charging caused by the drive stripe substance.

In this embodiment, a degree of the drive stripe contamination occurring in a process in which the cleaning blade strain is released after completion of the printing operation by which the cleaning blade is strained in the photosensitive drum driving direction, is decreased. In this embodiment, the number and timing of execution of the drive stripe substance preventing sequence are correlated with the print number but the present invention is not limited thereto. For example, the change in drive stripe contamination preventing sequence depending on the condition such as the operation environment condition or the integrated print number as described in Embodiment 2 is effective for further improving the drive stripe contamination occurrence level and for stabilizing the effect. In the case of, e.g., the high-temperature and the high-humidity, it is confirmed that the drive stripe substance accumulates in a short time or in a large amount. For this reason, in this case, the sequence actuation time is shortened and the number of execution of the sequence is increased. Similarly, e.g., in the case where the integrated print number is large, it is confirmed that the drive stripe substance accumulates in the short time or in the large amount. Therefore, the sequence actuation time is shortened and the number of execution of the sequence is increased.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 162265/2009 filed Jul. 8, 2009 and 148183/2010 filed Jun. 29, 2010, which is hereby incorporated by reference.

What is claimed is:

1. An image forming apparatus comprising:

a rotatable image bearing member;

a charging roller, contacting said image bearing member, for electrically charging said image bearing member;

a developing device for developing a latent image formed on said image bearing member into a developer image;

a cleaning device for removing a developer remaining on said image bearing member after the developer image is transferred from said image bearing member onto a developer image receiving member, wherein said cleaning device includes a cleaning blade contacting said image bearing member and having a fixed end and a free end which is located upstream of the fixed end with respect to a rotational direction of said image bearing member; and a control device for controlling a rotating operation of said image bearing member, wherein said control device is capable of performing an operation for rotating said image bearing member, in a direction identical to a rotational direction of said image bearing member during image formation, effected by rotating said image bearing member after a lapse, without next instruction of image formation, of a predetermined period from a stop of rotation of said image bearing member made after completion of the image formation, and wherein the predetermined period is longer with a larger number of sheets subjected to the image formation in an image forming job before the rotation of said image bearing member is stopped.

2. An apparatus according to claim 1, further comprising environment detecting means for detecting an environment, wherein the predetermined period is changed depending on the environment.

3. An apparatus according to claim 2, wherein the environment is a temperature and the predetermined period is made longer with an increasing temperature.

4. An apparatus according to claim 2, wherein the environment is a humidity and the predetermined period is made longer with an increasing humidity.

5. An apparatus according to claim 1, further comprising storing means for storing an operation history, wherein the predetermined period is made longer with an increasing operation history.

6. An image forming apparatus comprising:

a rotatable image bearing member;

a charging roller, contacting said image bearing member, for electrically charging said image bearing member;

a developing device for developing a latent image formed on said image bearing member into a developer image;

a cleaning device for removing a developer remaining on said image bearing member after the developer image is transferred from said image bearing member onto a developer image receiving member, wherein said cleaning device includes a cleaning blade contacting said image bearing member and having a fixed end and a free end which is located upstream of the fixed end with respect to a rotational direction of said image bearing member; and a control device for controlling a rotating operation of said image bearing member, wherein said control device is capable of performing multiple times of: (1) a rotation of said image bearing member in a direction identical to a rotational direction of said image bearing member during image formation, effected by rotating said image bearing member, and (2) a stop of the rotation, in a period from a stop of rotation of said image bearing member made after completion of the image formation until a subsequent image forming job is input, and wherein a number of the multiple times is larger with a larger number of sheets subjected to the image formation in an image forming job before the rotation of said image bearing member is stopped.

7. An apparatus according to claim 6, further comprising environment detecting means for detecting an environment, wherein the number of the multiple times is changed depending on the environment.

8. An apparatus according to claim 7, wherein the environment is a temperature and the number of the multiple times is made larger with an increasing temperature.

9. An apparatus according to claim 7, wherein the environment is a humidity and the number of the multiple times is made larger with an increasing humidity.

10. An apparatus according to claim 6, further comprising storing means for storing an operation history, wherein the number of the multiple times is made larger with an increasing operation history.

* * * * *